US010287757B1

(12) United States Patent
Saied

(10) Patent No.: US 10,287,757 B1
(45) Date of Patent: May 14, 2019

(54) QUICK CHANGE FAUCET AND SINK ASSEMBLY

(71) Applicant: Jihad Saied, Easton, PA (US)

(72) Inventor: Jihad Saied, Easton, PA (US)

( * ) Notice: Subject to any disclaimer, the term of this patent is extended or adjusted under 35 U.S.C. 154(b) by 14 days.

(21) Appl. No.: 15/671,244

(22) Filed: Aug. 8, 2017

(51) Int. Cl.

| | |
|---|---|
| ***E03C 1/00*** | (2006.01) |
| ***E03C 1/04*** | (2006.01) |
| ***E03C 1/042*** | (2006.01) |
| ***E03C 1/12*** | (2006.01) |
| *E03C 1/23* | (2006.01) |

(52) U.S. Cl.
CPC ..... *E03C 1/0401* (2013.01); *E03C 1/042* (2013.01); *E03C 1/12* (2013.01); *E03C 1/2302* (2013.01)

(58) Field of Classification Search
CPC ..... E03C 1/0401; E03C 1/042; E03C 1/12; E03C 1/2302
USPC ..... 4/696, 695
See application file for complete search history.

(56) References Cited

U.S. PATENT DOCUMENTS

| | | | | |
|---|---|---|---|---|
| 4,186,761 | A | 2/1980 | Guarnieri | |
| 5,375,272 | A | 12/1994 | Mikol | |
| 6,220,278 | B1 | 4/2001 | Sauter | |
| 6,293,322 | B1 * | 9/2001 | Wilson-South | E03C 1/33 144/137 |
| 6,405,749 | B1 | 6/2002 | Bloom | |
| 6,571,407 | B1 | 6/2003 | Skarie | |
| D483,651 | S | 12/2003 | Sander | |
| 7,039,966 | B1 | 5/2006 | Cranston, Jr. | |
| 7,210,493 | B1 * | 5/2007 | Wang | E03C 1/021 137/15.01 |
| 7,979,929 | B2 | 7/2011 | Vogel | |

FOREIGN PATENT DOCUMENTS

| | | | |
|---|---|---|---|
| WO | 02075183 | A2 | 9/2002 |

* cited by examiner

*Primary Examiner* — Huyen Le

(57) ABSTRACT

The quick change faucet and sink assembly is a sink. The quick change faucet and sink assembly is configured for use with one or more faucets. The quick change faucet and sink assembly comprises a sink, a mounting plate, first lap joint, and a second lap joint. The first lap joint and the second lap joint attach the mounting plate to the sink. The quick change faucet and sink assembly works as follows: the one or more faucets are installed in the mounting plate and then the mounting plate is attached to the sink. The one or more faucets can then be attached to the appropriate lines to provide water to the sink.

6 Claims, 4 Drawing Sheets

QUICK CHANGE FAUCET AND SINK ASSEMBLY

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of building and water supply, more specifically, a domestic plumbing installation for fresh water.

SUMMARY OF INVENTION

The quick change faucet and sink assembly is a sink. The quick change faucet and sink assembly is configured for use with one or more faucets. The quick change faucet and sink assembly comprises a sink, a mounting plate, first lap joint, and a second lap joint. The first lap joint and the second lap joint attach the mounting plate to the sink. The quick change faucet and sink assembly works as follows: the one or more faucets are installed in the mounting plate and then the mounting plate is attached to the sink. The one or more faucets can then be attached to the appropriate lines to provide water to the sink.

These together with additional objects, features and advantages of the quick change faucet and sink assembly will be readily apparent to those of ordinary skill in the art upon reading the following detailed description of the presently preferred, but nonetheless illustrative, embodiments when taken in conjunction with the accompanying drawings.

In this respect, before explaining the current embodiments of the quick change faucet and sink assembly in detail, it is to be understood that the quick change faucet and sink assembly is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the quick change faucet and sink assembly.

It is therefore important that the claims be regarded as including such equivalent construction insofar as they do not depart from the spirit and scope of the quick change faucet and sink assembly. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
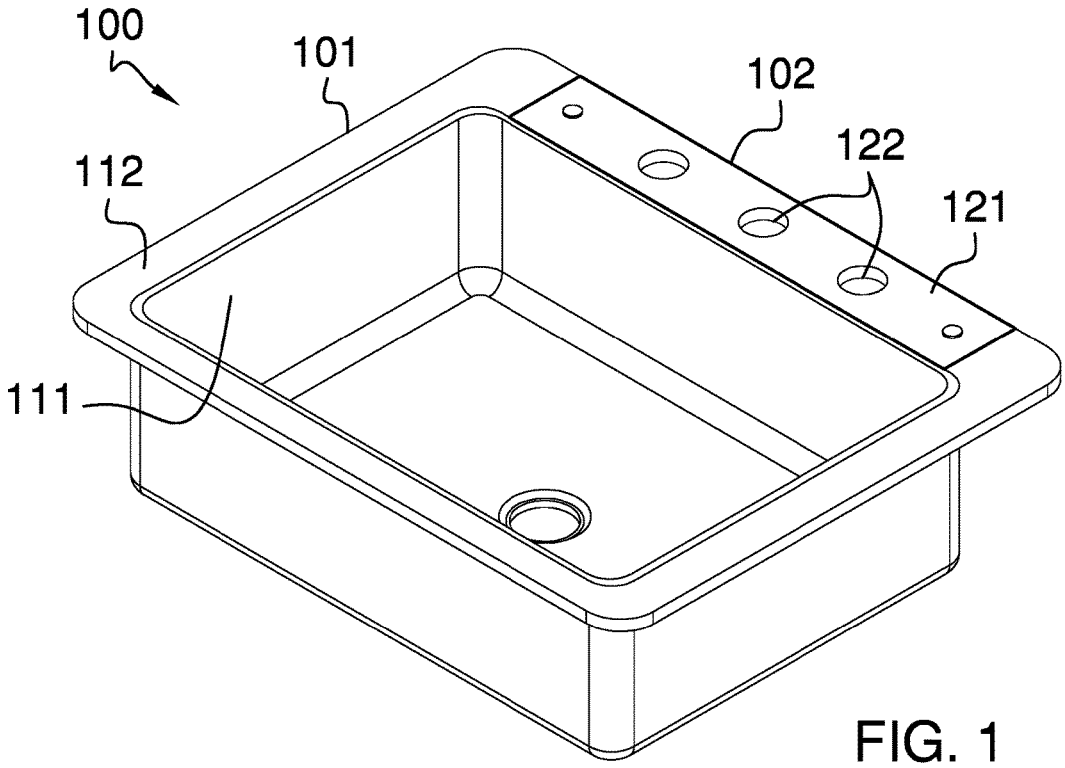
FIG. 1 is a perspective view of an embodiment of the disclosure.
Figure 2:
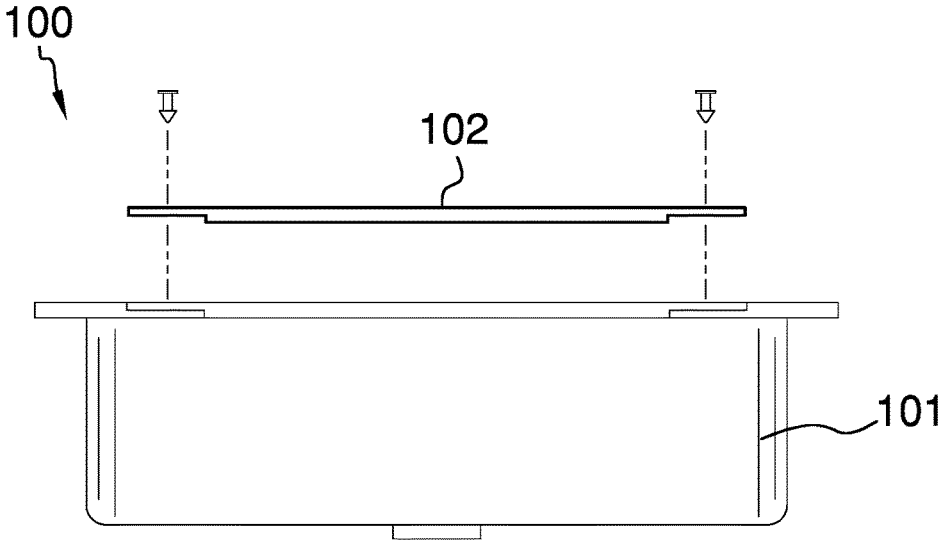
FIG. 2 is a rear view of an embodiment of the disclosure.
Figure 3:
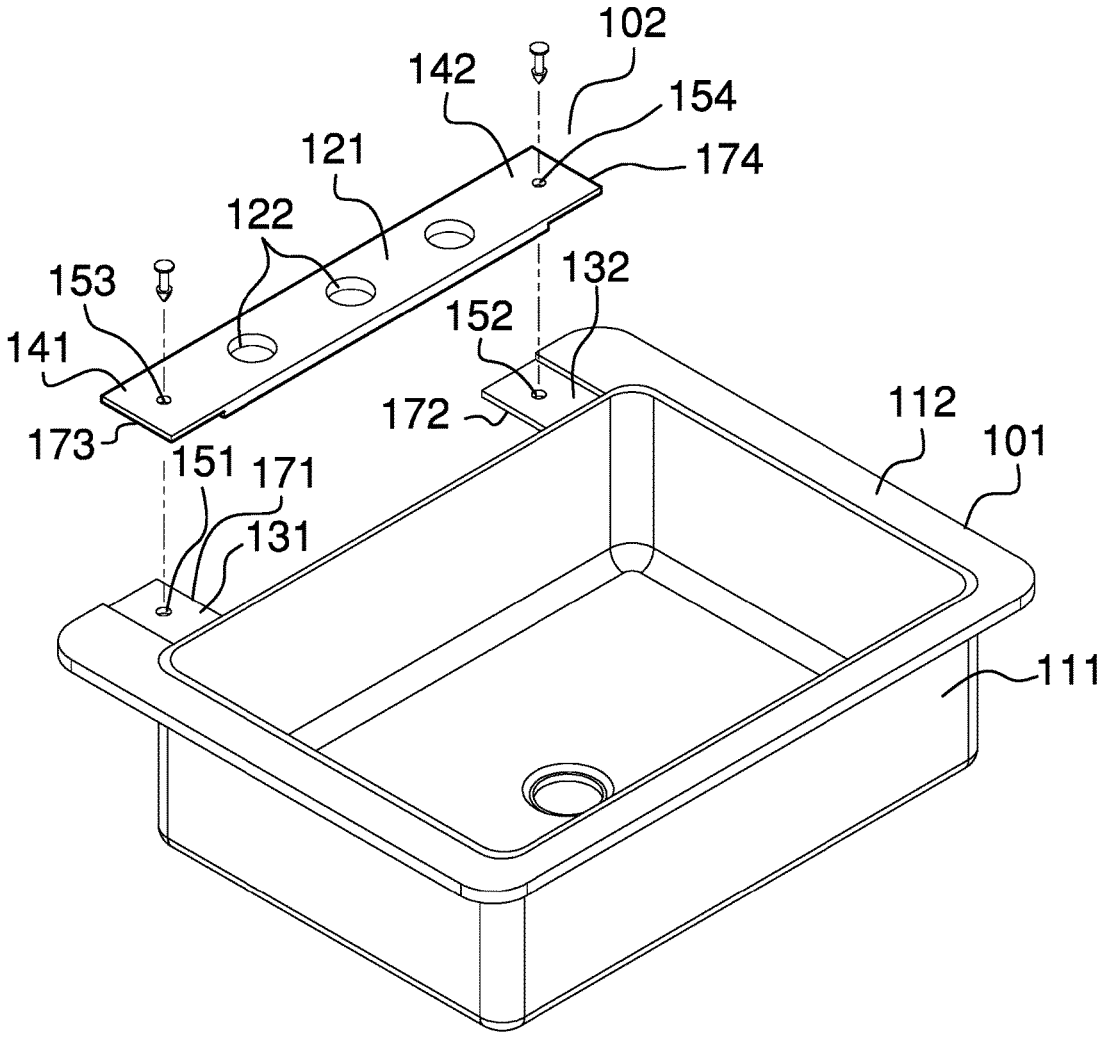
FIG. 3 is an exploded view of an embodiment of the disclosure.
Figure 4:
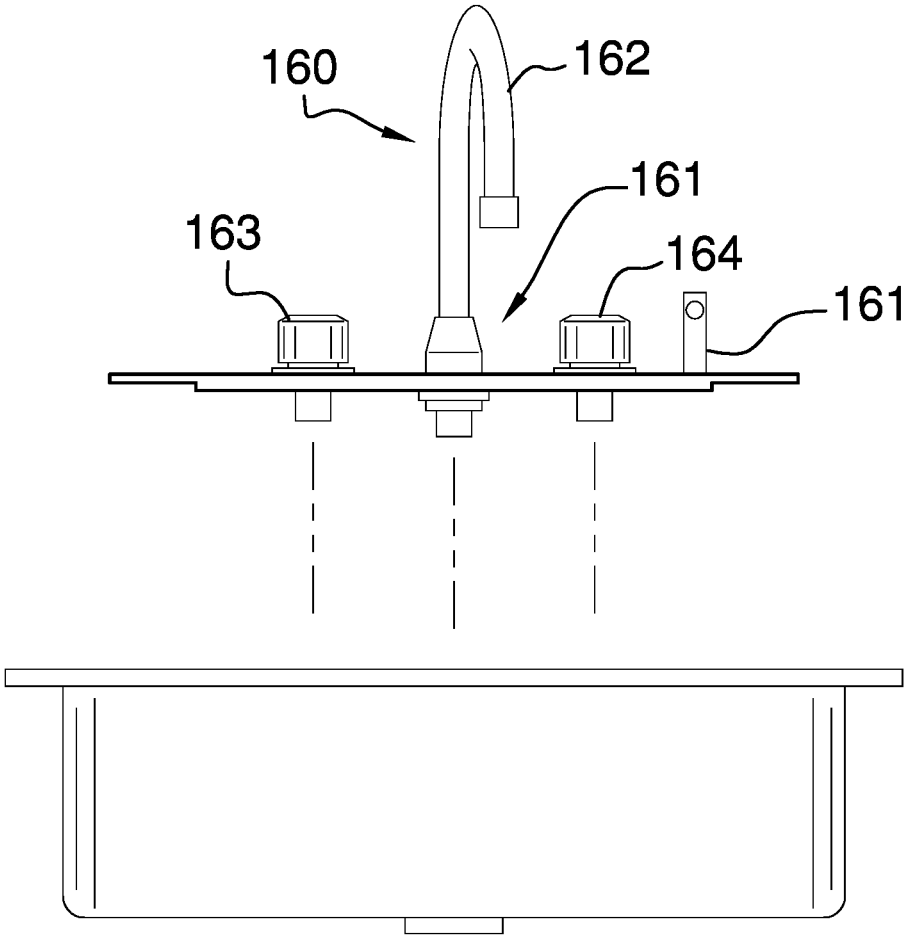
FIG. 4 is a front view of an embodiment of the disclosure.
Figure 5:
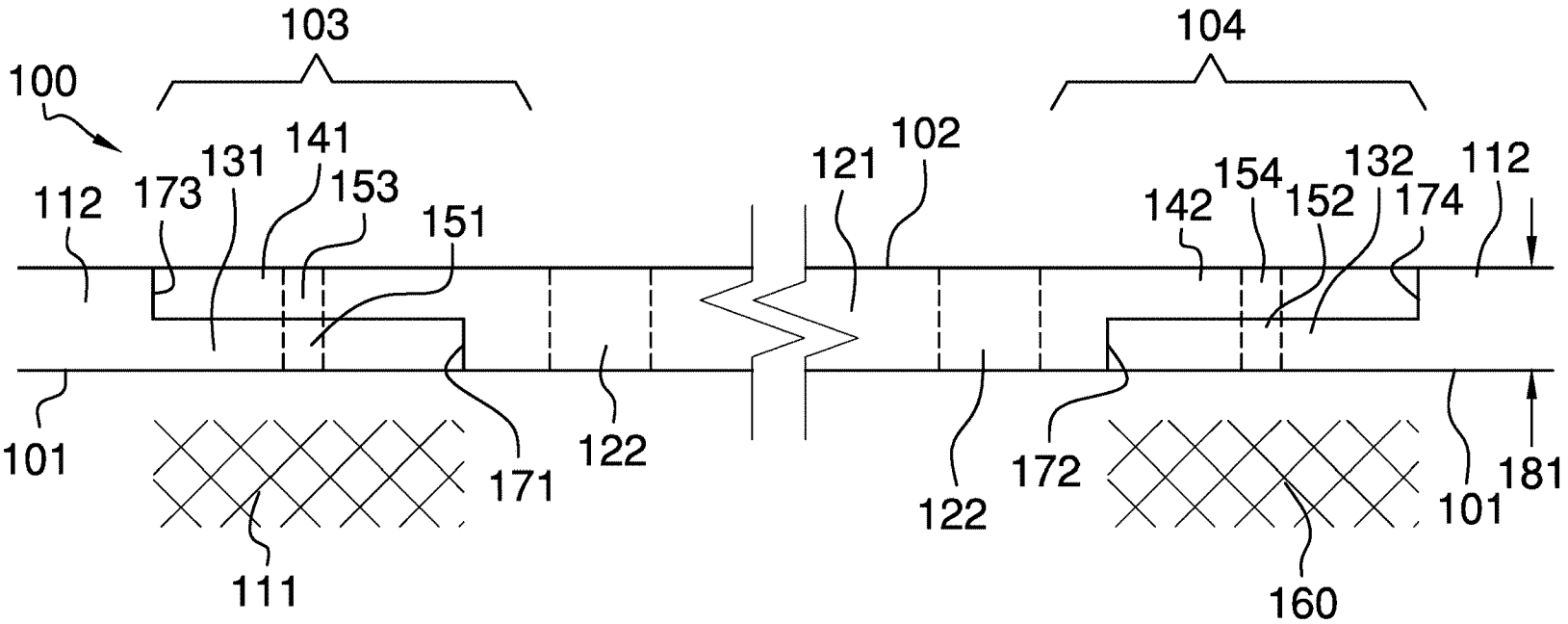
FIG. 5 is a detail view of an embodiment of the disclosure.

Detailed reference will now be made to one or more potential embodiments of the disclosure, which are illustrated in FIGS. 1 through 5.

The quick change faucet and sink assembly 100 (hereinafter invention) is a sink 101. The invention 100 is configured for use with one or more faucets 160. The invention 100 comprises a sink 101, a mounting plate 102, first lap joint 103, and a second lap joint 104. The first lap joint 103 and the second lap joint 104 attach the mounting plate 102 to the sink 101. The invention 100 works as follows: the one or more faucets 160 are installed in the mounting plate 102 and then the mounting plate 102 is attached to the sink 101. The one or more faucets 160 can then be attached to the appropriate lines to provide water to the sink 101.

The one or more faucets 160 comprises a collection of individual faucets 161. Each individual faucet 161 is further defined with one discharge pipe 162 and one or more valves 163. Each of the one or more faucets 160 are plumbing fittings that attach the sink 101 to the water source. Faucets are discussed in greater detail elsewhere in this disclosure.

The sink 101 is a water basin that is permanently positioned to a water source such as a domestic plumbing system. The sink 101 is used in conjunction with the one or more faucets 160 to receive water from the water source. The sink 101 comprises a basin 111 and a rim 112. The rim 112 is further defined with a first end 171 and a second end 172.

The basin 111 is a reservoir which captures the water drawn from the water source through the one or more faucets 160. The basin 111 is formed with an open superior face that provides access to the water contained within the sink 101. The open superior face of the basin 111 is further defined with a perimeter. The perimeter is further defined with a span.

The rim 112 is a lip that is formed along a portion of the perimeter of the open superior face of the basin 111. After the installation of the sink 101, the basin 111 hangs freely from the rim 112. The rim 112 forms a portion of the span of the perimeter of the basin 111. The rim 112 is further defined with a rim 112 span.

The mounting plate 102 is a structure that is removably attached to the sink 101. The one or more faucets 160 attach to the mounting plate 102. The mounting plate 102 is then removably attached to the sink 101 such that the one or more faucets 160 are attached to the sink 101. The mounting plate 102 comprises a removable structure 121 and a plurality of faucet apertures 122. The removable structure 121 is further defined with a third end 173 and a fourth end 174.

The removable structure 121 is a metal plate structure formed in a rectangular shape. The removable structure 121 attaches to the rim 112 of the sink 101 such that the removable structure 121 forms a portion of the perimeter of the open superior face of the basin 111. The removable structure 121 is further defined with a plate span. The sum of the spans of the plate span of the removable structure 121 and the rim 112 span of the rim 112 is equal to or greater than the span of the perimeter of the open superior face of the basin 111.

Each of the plurality of faucet apertures 122 is an aperture that is formed through the removable structure 121. Each of the plurality of faucet apertures 122 receives a fixture selected from the group consisting of: 1) the discharge pipe 162 of an individual faucet 161 selected from the one or more faucets 160; or, 2) a valve selected from the one or more valves 163 of an individual faucet 161 selected from the one or more faucets 160. Stated less formally, the discharge pipe 162 and the one or more valves 163 of each individual faucet 161 contained within the one or more faucets 160 are installed in an aperture selected from the plurality of faucet apertures 122 of the mounting plate 102. The one or more faucets 160 are installed into the plurality of faucet apertures 122 before the removable structure 121 is installed.

The rim 112 and the removable structure 121 are further defined with a thickness 181 dimension. The span of the thickness 181 dimension of the rim 112 equals the span of the thickness 181 dimension of the removable structure 121.

The first lap joint 103 is a traditional lap joint that is formed between the mounting plate 102 and the sink 101. The first lap joint 103 attaches the mounting plate 102 to the sink 101. The first lap joint 103 comprises a first rim half lap joint 131 and a first plate half lap joint 141.

The first rim half lap joint 131 is formed on the first end 171 of the rim 112. The first plate half lap joint 141 is formed on the third end 173 of the removable structure 121. The first rim half lap joint 131 further comprises a first attachment aperture 151. The first plate half lap joint 141 further comprises a third attachment aperture 153. The first attachment aperture 151 is a cylindrical hole that is formed through the first rim half lap joint 131. The third attachment aperture 153 is a cylindrical hole that is formed through the first plate half lap joint 141.

The first rim half lap joint 131 is further defined with a thickness 181 dimension. The span of the thickness 181 dimension of the first rim half lap joint 131 equals one half of the span of the thickness 181 dimension of the rim 112. The first plate half lap joint 141 is further defined with a thickness 181 dimension. The span of the thickness 181 dimension of the first plate half lap joint 141 equals one half of the span of the thickness 181 dimension of the removable structure 121.

The second lap joint 104 is a traditional lap joint that is formed between the mounting plate 102 and the sink 101. The second lap joint 104 attaches the mounting plate 102 to the sink 101. The second lap joint 104 comprises a second rim half lap joint 132 and a second plate half lap joint 142.

The second rim half lap joint 132 is formed on the second end 172 of the rim 112. The second plate half lap joint 142 is formed on the fourth end 174 of the removable structure 121. The second rim half lap joint 132 further comprises a second attachment aperture 152. The second plate half lap joint 142 further comprises a fourth attachment aperture 154. The second attachment aperture 152 is a cylindrical hole that is formed through the second rim half lap joint 132. The fourth attachment aperture 154 is a cylindrical hole that is formed through the second plate half lap joint 142.

The second rim half lap joint 132 is further defined with a thickness 181 dimension. The span of the thickness 181 dimension of the second rim half lap joint 132 equals one half of the span of the thickness 181 dimension of the rim 112. The second plate half lap joint 142 is further defined with a thickness 181 dimension. The span of the thickness 181 dimension of the second plate half lap joint 142 equals one half of the span of the thickness 181 dimension of the removable structure 121.

The installation of the invention 100 is described in the following four paragraphs.

The sink 101 is installed into a pedestal in the normal fashion.

The first lap joint 103 is joined by overlaying the first plate half lap joint 141 on to the first rim half lap joint 131 such that the center axis of the third attachment aperture 153 is aligned with the center axis of the first attachment aperture 151. The first plate half lap joint 141 and the first rim half lap joint 131 are secured together by inserting commercially available hardware simultaneously through the third attachment aperture 153 and the first attachment aperture 151. Suitable commercially available hardware includes, but is not limited to a bolt and nut.

The second lap joint 104 is joined by overlaying the second plate half lap joint 142 on to the second rim half lap joint 132 such that the center axis of the fourth attachment aperture 154 is aligned with the center axis of the second attachment aperture 152. The second plate half lap joint 142 and the second rim half lap joint 132 are secured together by inserting commercially available hardware simultaneously through the fourth attachment aperture 154 and the second attachment aperture 152. Suitable commercially available hardware includes, but is not limited to a bolt and nut.

The one or more faucets 160 can then be connected to the water source in the normal manner. In the first potential embodiment of the disclosure, it is presumed that the diameter of each plurality of faucet apertures 122 is customized to receive a fixture selected from the group consisting of the discharge pipe 162 and the one or more valves 163 for a specifically identified commercially available individual faucet 161.

The following definitions were used in this disclosure:

Aperture: As used in this disclosure, an aperture is a cylindrical negative space that is formed completely through a structure.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder. The center axis of a pyramid refers to a line formed through the apex of the pyramid that is perpendicular to the base of the pyramid. When the center axes of two cylinder or cylinder like structures share the same line they are said to be aligned. When the center axes of two cylinder like structures do not share the same line they are said to be offset.

Cylinder: As used in this disclosure, a cylinder is a geometric structure defined by two identical flat and parallel ends, also commonly referred to as bases, which are circular in shape and connected with a single curved surface, referred to in this disclosure as the face. The cross section of the cylinder remains the same from one end to another. The axis of the cylinder is formed by the straight line that connects the center of each of the two identical flat and parallel ends of the cylinder. Unless otherwise stated within this disclosure, the term cylinder specifically means a right cylinder, which is defined as a cylinder wherein the curved surface perpendicularly intersects with the two identical flat and parallel ends.

Diameter: As used in this disclosure, a diameter of an object is a straight line segment, or a radial line, that passes through the center or a center axis of an object. The line segment of the diameter is terminated at the perimeter or boundary of the object through which the line segment of the diameter runs.

Faucet: As used in this disclosure, a faucet refers to a valve and a discharge pipe that draws water from a pipe or reservoir and discharges the drawn water through the discharge pipe. When the term faucet is applied to a sink, the term faucet refers to a single discharge pipe and all the valves that feed the discharge pipe.

Force of Gravity: As used in this disclosure, the force of gravity refers to a vector that indicates the direction of the pull of gravity on an object at or near the surface of the earth.

Hang: As used in this disclosure, to hang an object is to suspend an object above a surface from above such that the inferior end of the object can move freely.

Inferior: As used in this disclosure, the term inferior refers to a directional reference that is parallel to and in the same direction as the force of gravity.

Inner Diameter: As used in this disclosure, the term inner diameter is used in the same way that a plumber would refer to the inner diameter of a pipe.

Lap Joint: As used in this disclosure, a lap joint refers to two objects of the same thickness that are joined using a rectilinear notch formed in an edge of each of the two objects. The two notches are overlaid on each other such that the two objects overlap at the rectilinear notches such that the overall thickness overlapping regions of the two objects is the same as the overall thickness of either object. The term "half lap joint" refers to the end of a selected object that has the rectilinear notch formed in it. Lap joints are well known and documented in the carpentry arts.

Negative Space: As used in this disclosure, negative space is a method of defining an object through the use of open or empty space as the definition of the object itself, or, through the use of open or empty space to describe the boundaries of an object.

Notch: As used in this disclosure, a notch is: 1) an indentation formed in an edge; or 2) a cavity or aperture formed within a surface.

Outer Diameter: As used in this disclosure, the term outer diameter is used in the same way that a plumber would refer to the outer diameter of a pipe.

Pipe: As used in this disclosure, a pipe is a hollow cylindrical device that is used for transporting liquids and gases. The line that connects the center of the first base of the cylinder to the center of the second base of the cylinder is referred to as the axis of the cylinder or the centerline of the pipe. When two pipes share the same centerline they are said to be aligned. In this disclosure, the terms inner diameter of a pipe and outer diameter are used as they would be used by those skilled in the plumbing arts.

Reservoir: As used in this disclosure, a reservoir refers to a container or containment system that is configured to store a liquid.

Rim: As used in this disclosure, a rim is an outer edge or border that follows along the perimeter of an object.

Sink: As used in this disclosure, a sink is a permanently installed water basin that is attached to one or more water sources.

Superior: As used in this disclosure, the term superior refers to a directional reference that is parallel to and in the opposite direction of the force of gravity.

Tradition: As used in this disclosure, a tradition refers to: 1) a set of thoughts or expectations regarding a subject or object; or, 2) a method of using an object; that, 3) is perceived to be widely or commonly shared across a population of people; and that, 4) is perceived to be widely or commonly shared across at least two generations within the population of people.

Valve: As used in this disclosure, a valve is a device that is use to control the flow of a fluid (gas or liquid) through a pipe.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A domestic plumbing apparatus comprising:

a sink, a mounting plate, first lap joint, and a second lap joint;

wherein the first lap joint and the second lap joint attach the mounting plate to the sink;

wherein the domestic plumbing apparatus is configured for use with one or more faucets;

wherein the one or more faucets are installed in the mounting plate before the mounting plate is attached to the sink;

wherein the one or more faucets comprises a collection of individual faucets;

wherein each individual faucet is further defined with one discharge pipe and one or more valves;

wherein the sink is a water basin;

wherein the one or more faucets attaches to a water source;

wherein the sink is used in conjunction with the one or more faucets to receive water from a water source;

wherein the mounting plate is removably attached to the sink;

wherein the one or more faucets attach to the mounting plate;

wherein the sink comprises a basin and a rim;

wherein the rim is further defined with a first end and a second end;

wherein the basin is a reservoir;

wherein the basin captures the water drawn from the one or more faucets;

wherein the basin is formed with an open superior face;

wherein the open superior face of the basin is further defined with a perimeter;

wherein the rim is a lip that is formed along a the perimeter of the open superior face;

wherein the basin hangs freely from the rim;

wherein the rim forms a portion of the perimeter of the basin;

wherein the rim is further defined with a rim span;

wherein the mounting plate comprises a removable structure and a plurality of faucet apertures;

wherein each of the plurality of faucet apertures is an aperture that is formed through the removable structure;

wherein the removable structure is further defined with a third end and a fourth end;

wherein the removable structure is a metal plate structure formed in a rectangular shape;

wherein the removable structure is further defined with a plate span;

wherein the removable structure attaches to the rim of the sink such that the removable structure forms a portion of the perimeter of the open superior face of the basin;

wherein the sum of the spans of the plate span of the removable structure and the rim span of the rim is equal to or greater than the span of the perimeter of the open superior face of the basin;

wherein each of the plurality of faucet apertures receives a fixture selected from the group consisting of: 1) the discharge pipe of an individual faucet selected from the one or more faucets; or, 2) a valve selected from the one or more valves of an individual faucet selected from the one or more faucets;

wherein the one or more faucets are installed into the plurality of faucet apertures before the removable structure is installed;

wherein the rim and the removable structure are further defined with a thickness dimension;

wherein the span of the thickness dimension of the rim equals the span of the thickness dimension of the removable structure;

wherein the first lap joint comprises a first rim half lap joint and a first plate half lap joint;

wherein the first rim half lap joint is formed on the first end of the rim;

wherein the first plate half lap joint is formed on the third end of the removable structure;

wherein the first rim half lap joint further comprises a first attachment aperture;

wherein the first plate half lap joint further comprises a third attachment aperture;

wherein the first attachment aperture is a cylindrical hole that is formed through the first rim half lap joint;

wherein the third attachment aperture is a cylindrical hole that is formed through the first plate half lap joint;

wherein the first attachment aperture is further defined with a first center axis;

wherein the third attachment aperture is further defined with a third center axis.

2. The domestic plumbing apparatus according to claim 1 wherein the first rim half lap joint is further defined with a thickness dimension;

wherein the first plate half lap joint is further defined with a thickness dimension;

wherein the span of the thickness dimension of the first rim half lap joint equals one half of the span of the thickness dimension of the rim;

wherein the span of the thickness dimension of the first plate half lap joint equals one half of the span of the thickness dimension of the removable structure.

3. The domestic plumbing apparatus according to claim 2 wherein the second lap joint comprises a second rim half lap joint and a second plate half lap joint;

wherein the second plate half lap joint is formed on the fourth end of the removable structure;

wherein the second rim half lap joint is formed on the second end of the rim;

wherein the second rim half lap joint further comprises a second attachment aperture;

wherein the second plate half lap joint further comprises a fourth attachment aperture;

wherein the second attachment aperture is a cylindrical hole that is formed through the second rim half lap joint;

wherein the fourth attachment aperture is a cylindrical hole that is formed through the second plate half lap joint;

wherein the second attachment aperture is further defined with a second center axis;

wherein the fourth attachment aperture is further defined with a fourth center axis.

4. The domestic plumbing apparatus according to claim 3 wherein the second rim half lap joint is further defined with a thickness dimension;

wherein the second plate half lap joint is further defined with a thickness dimension;

wherein the span of the thickness dimension of the second rim half lap joint equals one half of the span of the thickness dimension of the rim;

wherein the span of the thickness dimension of the second plate half lap joint equals one half of the span of the thickness dimension of the removable structure.

5. The domestic plumbing apparatus according to claim 4 wherein the first lap joint is joined by overlaying the first plate half lap joint on to the first rim half lap joint such that the center axis of the third attachment aperture is aligned with the center axis of the first attachment aperture;

wherein the first plate half lap joint and the first rim half lap joint are secured with hardware.

6. The domestic plumbing apparatus according to claim 5 wherein the second lap joint is joined by overlaying the second plate half lap joint on to the second rim half lap joint such that the center axis of the fourth attachment aperture is aligned with the center axis of the second attachment aperture;

wherein the second plate half lap joint and the second rim half lap joint are secured with hardware.

* * * * *